United States Patent [19]

Hendricks

[11] 4,248,140

[45] Feb. 3, 1981

[54] DUCT OUTLET

[76] Inventor: Herman M. Hendricks, 538 Flat River Dr., Lowell, Mich. 49331

[21] Appl. No.: 971,232

[22] Filed: Dec. 20, 1978

[51] Int. Cl.[3] ..... F24F 7/00

[52] U.S. Cl. ..... 98/41 R; 98/40 R

[58] Field of Search ..... 98/41 R, 40 VM, 40 V, 98/40 D, 40 R, 40 A, 41 AV

[56] References Cited

U.S. PATENT DOCUMENTS

| | | | |
|---|---|---|---|
| 2,104,279 | 1/1938 | Sperry | 98/40 V |
| 2,735,353 | 2/1956 | Griner | 98/40 V |
| 2,783,702 | 3/1957 | O'Day | 98/40 D |
| 2,894,444 | 7/1959 | Boylan et al. | 98/40 V |
| 3,420,448 | 1/1969 | Snow | 98/41 R |

FOREIGN PATENT DOCUMENTS

| | | | |
|---|---|---|---|
| 2018439 | 10/1971 | Fed. Rep. of Germany | 98/41 AV |
| 90701 | 11/1957 | Norway | 98/41 R |
| 1310493 | 3/1973 | United Kingdom | 98/40 A |

*Primary Examiner*—Albert J. Makay
*Assistant Examiner*—Henry Bennett
*Attorney, Agent, or Firm*—Glenn B. Morse

[57] ABSTRACT

A tubular section of a duct outlet unit normally is received in an opening in a room wall panel. A grille is rotatably mounted in the outlet end of the unit, and has an axial extension received in a bearing supported by a diametral beam extending across the opposite end of the tubular section. A damper assembly is carried by the axial grille extension, and has adjustment handles extending through a grille opening.

5 Claims, 5 Drawing Figures

DUCT OUTLET

BACKGROUND OF THE INVENTION

Heating and air conditioning ducts normally extend from a plenum to an opening in a wall or floor. The outlet units installed in these openings usually have some sort of mounting flange attachable to the surrounding panel structure, and some arrangement for connecting the outlet unit to the remainder of the duct system. The present invention is associated with a type of installation frequently encountered in recreational vehicles, in which the outlet duct is installed in an opening in a wall panel, and connected to the plenum by flexible ducting consisting essentially of fabric surrounding an open-wound helical wire, which maintains the shape of the duct and permits relatively sharp turns. The outlet units are normally provided with some form of grille, which may provide louvre surfaces inclined to the axis of the air flow. Rotatability of the grille with respect to the outlet gives some degree of directional control over the air flow. The extensive use of these devices justifies the application of high-production molding techniques, and competitive factors cause very small differences in the cost of manufacture to become very significant.

The following patents have been noted as of general interest in connection with these outlet devices:

| | | |
|---|---|---|
| Germonprez | 1,952,707 | 1934 |
| Mattingly | 2,733,889 | 1956 |
| Fadow | 3,333,522 | 1967 |
| Eggers | 3,570,387 | 1971 |

SUMMARY OF THE INVENTION

This duct outlet has a tubular outer housing adapted to be inserted in a wall opening, and a grille unit rotatably mounted at the outlet end. The grille has an axial extension received in a bearing carried by a transverse beam extending across the opposite end of the housing, and a damper assembly is mounted on this grille extension. Control handles associated with the dampers extend through an opening in the grille. A flexible duct is attachable to the inner end of the housing with a U-shaped clip shoved over the end of the wall forming the tubular configuration, with the clip being provided with a barb that digs into the material to prevent axial withdrawal after installation. One side of the clip is elongated and inclined to provide a cantilever spring disposed on the outside of the housing, and underneath the flexible duct fitted over the housing end. Preferably, the cantilever spring is interengaged in the space between two coils of a helical wire reinforcement, and has a configuration engagable with the wire.

DESCRIPTION OF THE PREFERRED EMBODIMENT

Figure 2:
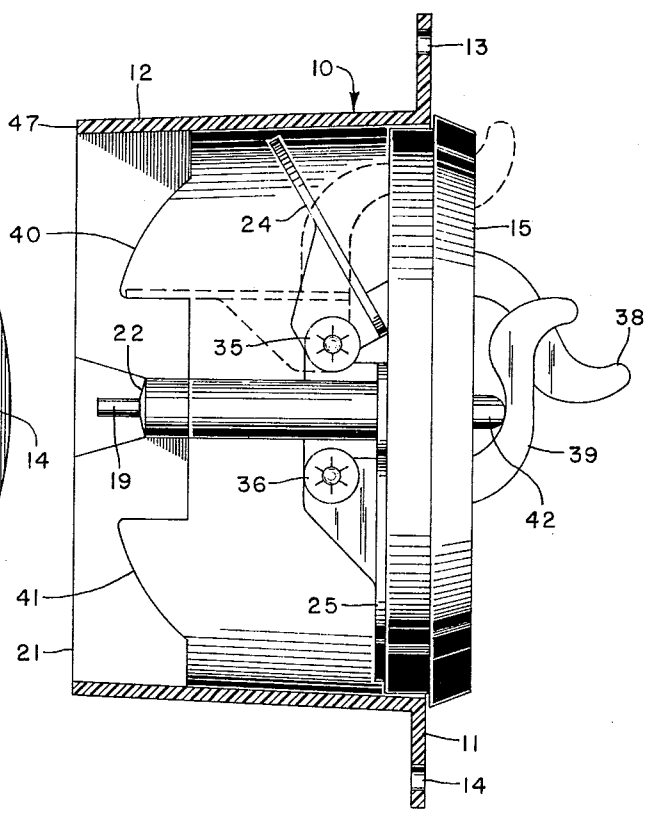
FIG. 2 is an axial sectional elevation of the unit shown in FIG. 1.

Referring to the drawings, the duct outlet unit includes the outer housing generally indicated at 10 having a mounting flange 11 and a generally cylindrical tubular section 12 normally traversing an opening in a wall panel, with the unit being secured in place by the application of screws through the holes 13 and 14 in the flange 11. A grille 15 has a ring-shaped peripheral frame 16 with an offset 17 received against the outer surface of the mounting flange 11, and a group of louvres 18 disposed in planes inclined to the axis of the assembly to provide a directional component for the outflow of air through the louvres.

The grille has an axial extension 19, the end of which has a reduced diameter received in the bearing 20 integral with the transverse beam 21 bridging across the inner end of the housing in the position of a diameter. In the assembled relationship of the unit shown in FIG. 2, a standard gripping washer 22 is slipped over the projecting end of the axial extension 19 to maintain the assembled relationship of the grille and the housing. The washer 22 is shoved into position such that the axial extension 19 and the washer are rotatable together with respect to the beam 21.

Figure 1:
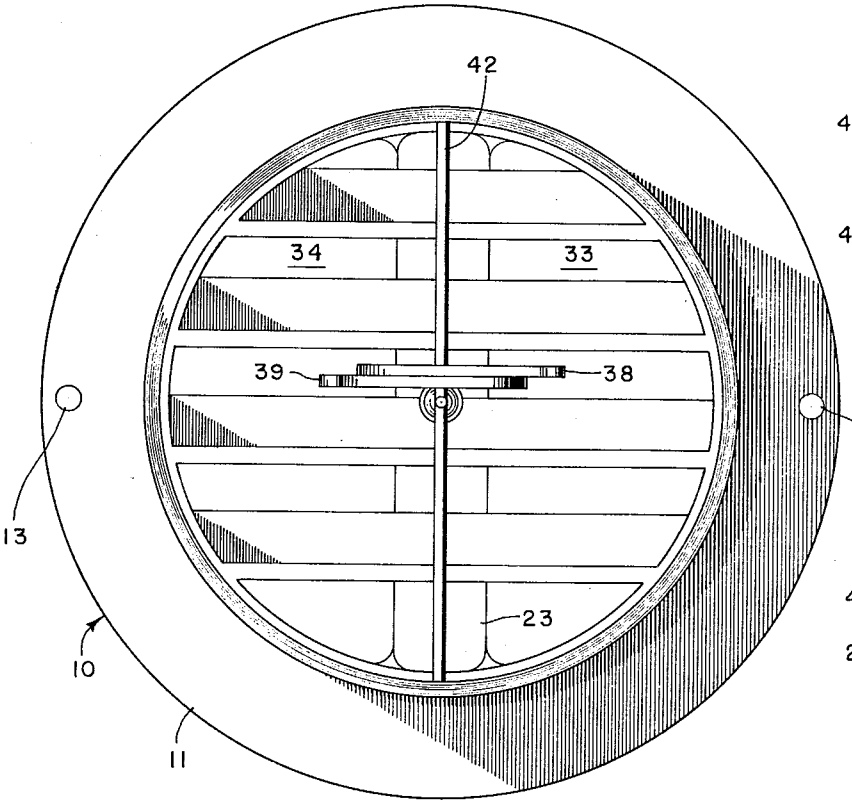
FIG. 1 is a front elevation of the complete duct outlet unit.
Figure 3:
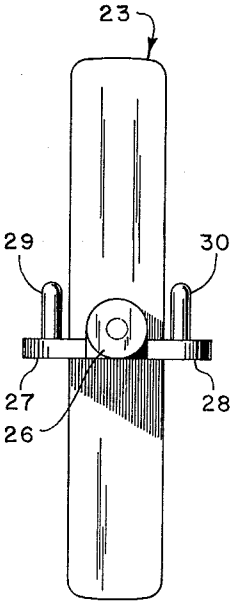
FIG. 3 is a front elevation of the damper carrier.
Figure 4:
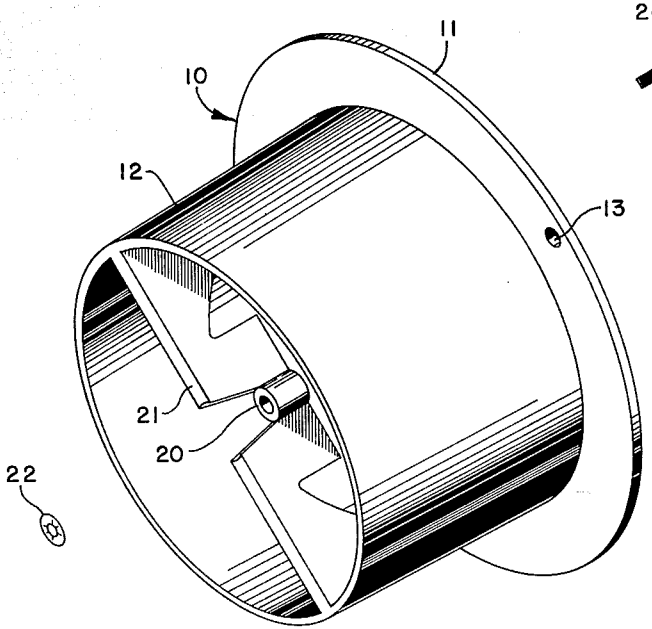
FIG. 4 is an exploded view showing the components of the unit.

Prior to the installation of the grille into the housing, the damper assembly is installed over the axial extension 19. This damper assembly is illustrated in the central portion of FIG. 4, and includes the carrier 23 shown in FIG. 3 and the damper components 24 and 25. The tubular central portion 26 of the carrier 23 is loosely received over the grille extension 19, and the damper support brackets 27 and 28 on the opposite sides of the carrier are provided with the journal studs 29 and 30, respectively, which engage with appropriate bearing holes in the flanges 31 and 32 integral with the damper plates 33 and 34, respectively. Retaining washers 35 and 36, which are similar to the washer 22, maintain the assembled relationship of the dampers with the carrier. The transverse bar 37 of the carrier 23 covers the area between the dampers when they are in closed position. The angular relationship of the dampers is adjusted by manipulation of the handles 38 and 39 associated respectively with the dampers 24 and 25, the handles extending through an opening between the louvres of the grille unit, as shown in FIG. 1. The handles 38 and 39 are offset sufficiently to permit an overlaid relationship so that they can move through the range of angular adjustment without interference. To provide a maximum sweep for the dampers, giving them a fully open position, the beam 21 may be cut out as shown at 40 and 41 to permit placement of dampers in the dotted line position shown in FIG. 2. In this figure, the lower damper 25 is shown in the closed position. At the opposite end of the device, the integral rib 42 extends across the louvre unit and reinforces the louvre components. This member also functions as a stop determining the closed position of the handles 38 and 39, as shown in FIG. 2.

Figure 5:
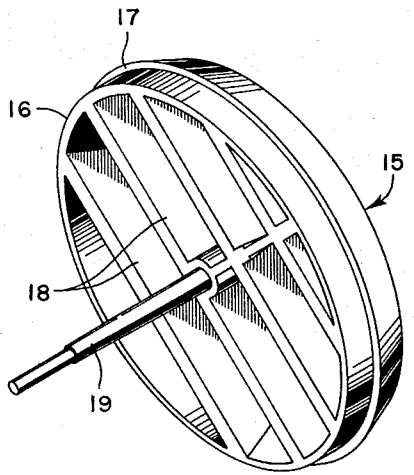
FIG. 5 is a fragmentary sectional elevation showing the interengagement of the flexible duct outlet with the inner end of the housing of the unit.
Figure 5:
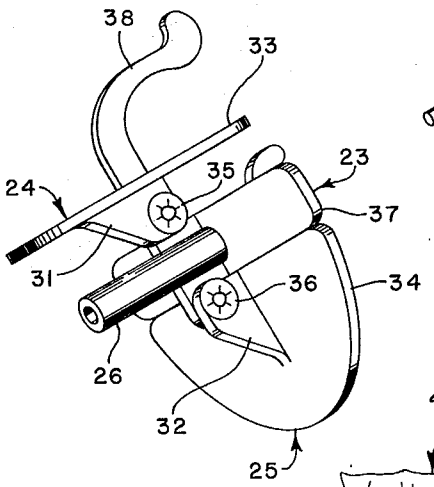
Figure 5:
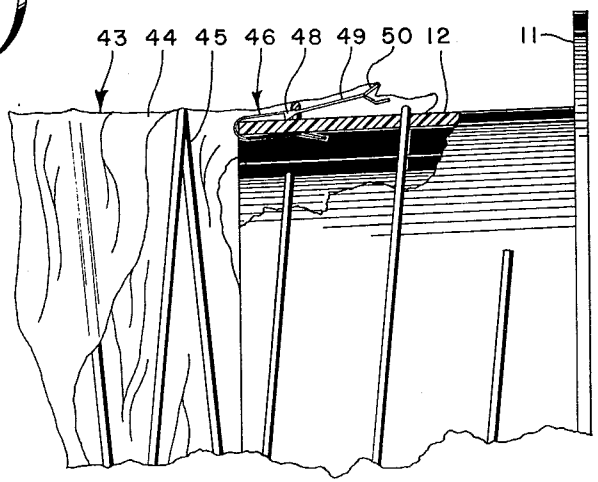

Referring to FIG. 5, the flexible duct 43 is slipped over the inner end of the tubular section of the housing 12. This duct has a tubular fabric 44 reinforced by a helical wire 45, which is retained in place by one or more clips 46. These clips have a U-shaped section received over the inner end 47 of the housing, and retained by the barb 48 which digs into the material of the housing 12 under the pressure of the spring resiliency of the clip material. The outer end 39 of the clip is inclined away from the housing 12 to form a cantilever resilient section preferably interposed between the coils of wire 45 of the flexible duct, with the end 50 of the clip preferably having a configuration to entrap the wire in the event of forces being applied to dislodge the duct axially toward disengagement from the outlet unit. Normally, the cantilever end of the clip will press outwardly into the fabric 44, and inhibit the withdrawal of the flexible duct without actual engagement with the wire being required.

I claim:

1. A duct outlet having a tubular housing, a grille rotatably mounted in one end of said housing, and damper means mounted within said housing, wherein the improvement comprises:

a beam bridging across said housing at the opposite end thereof from said grille, said beam having a bearing coaxial with the axis of said housing, said grille having an apertured face and an axial extension from said face coaxial with and received within said bearing;

a damper carrier having a central tubular portion telescopingly received over said grille axial extension and interposed between said beam and said grille face, and having at least one support bracket on a side thereof;

a damper pivotally mounted on said bracket, said damper having a control handle extending through an opening in said grille; and securing means maintaining the engagement of said grille axial extension in said bearing.

2. A duct outlet as defined in claim 1, wherein said grille has a flange axially overlying a portion of the outer end of said housing.

3. A duct outlet as defined in claim 1, wherein said damper carrier has brackets on opposite sides thereof each supporting a damper, said grille opening being elongated in a direction transverse to said axis, and said damper handles being received in said opening.

4. A duct outlet as defined in claim 3, wherein said damper handles operate in different planes providing passage clearance with respect to each other during adjustment of the angular position of said dampers with respect to said damper carrier.

5. A duct outlet as defined in claim 1, wherein one of said duct outlet and said bracket has a projecting stud, and the other thereof has a bearing portion receiving said stud, and including securing means maintaining the engagement thereof.

* * * * *